United States Patent [19]

Portmann

[11] Patent Number: 4,544,815

[45] Date of Patent: Oct. 1, 1985

[54] MULTIPLE KEY SWITCH

[75] Inventor: Albert Portmann, Murten, Switzerland

[73] Assignee: SODECO - SAIA AG, Murten, Switzerland

[21] Appl. No.: 577,623

[22] PCT Filed: May 5, 1983

[86] PCT No.: PCT/CH83/00056

§ 371 Date: Jan. 17, 1984

§ 102(e) Date: Jan. 17, 1984

[87] PCT Pub. No.: WO84/00639

PCT Pub. Date: Feb. 16, 1984

[30] Foreign Application Priority Data

Jul. 22, 1982 [CH] Switzerland ..... 4476/82

[51] Int. Cl.[4] ..... H01H 1/20; H01H 9/26; H01H 15/06

[52] U.S. Cl. ..... 200/50 C; 200/16 A

[58] Field of Search ..... 200/16 A, 50 C, 243, 200/5 R, 5 B, 5 D, 18; 335/127, 131, 159-161; 337/43, 45

[56] References Cited

U.S. PATENT DOCUMENTS

| | | | |
|---|---|---|---|
| 2,349,616 | 5/1944 | Ellis et al. | 200/50 C |
| 3,018,338 | 1/1962 | Mullen et al. | 200/16 A |
| 3,142,732 | 7/1964 | Clarke et al. | 200/50 C |
| 3,408,464 | 10/1968 | Earlywine, Jr. et al. | 200/16 A |
| 4,052,582 | 10/1977 | Mullen et al. | 200/16 A X |

FOREIGN PATENT DOCUMENTS

| | | |
|---|---|---|
| 644081 | 4/1937 | Fed. Rep. of Germany . |
| 667361 | 11/1938 | Fed. Rep. of Germany . |
| 952915 | 11/1956 | Fed. Rep. of Germany . |
| 971322 | 1/1959 | Fed. Rep. of Germany . |
| 2702225 | 8/1977 | Fed. Rep. of Germany . |
| 2618572 | 11/1977 | Fed. Rep. of Germany . |
| Ad.64500 | 7/1953 | France . |
| 1169029 | 9/1958 | France . |

*Primary Examiner*—J. R. Scott

*Attorney, Agent, or Firm*—Ernest F. Marmorek

[57] ABSTRACT

A multipole key switch comprises switching chambers disposed next to each other are each provided with a movable contact bridge, which shortens a pair of contact fingers in each case in the turned on condition. Contact supports for supporting the contact bridges are formed at a cross-web of an actuating arm. Each switching chamber is provided with a restoring spring. The force of only two restoring springs can bring the key switch into its switched-off position. In order to prevent a sideways canting or clamping of the actuating ram, it is provided with two ribs, with the aid of which it is guided in a guide track.

5 Claims, 2 Drawing Figures

MULTIPLE KEY SWITCH

DESCRIPTION

BACKGROUND OF THE INVENTION

1. Field of the Invention

The invention relates to a multipole key switch with an actuating ram longitudinally slidable against the force of a restoring spring, which actuating ram engages at least two contact bridges disposed next to each other and placed under a spring restoring force for the shorting out or, respectively, lifting off from fixed position contact fingers disposed in switching chambers, where the pretensioning force of the spring of the contact bridges generates the required contact pressure and where each switching chamber is provided with its own restoring spring.

2. Brief Description of the Background of the Invention Including Prior Art

Key switches are employed in various ways for indicating a state such as for example the final position of a machine table, the closure of a door, of a cover or of similar elements. A portion of the path of the motion of the part to be surveyed is taken directly for actuating of a switch ram. Such a single pole switch is shown in German Patent DE-PS No. 952,915. In application situations where more than one electrical circuit are to be switched, it is also known from German Patent DE-PS No. 971,322 to dispose several switches in spacial sequence following each other. In many cases this results in impermissibly large construction heights in particular in cases where the switch is employed not only for a small voltage, but also for the low voltage grid and where the required distances and creeping paths are to be maintained between the various parts relative to each part and also relative to ground.

The French Patent FR-PS No. 1,169,029 (Etabl. Labinal) also shows a key switch with switching chambers disposed next to each other, the contact bridges of which are actuable with a single actuating ram. Also each of the switching chambers is provided with its proper reset switch, which however acts only on its own switching chamber. In case a reset spring is broken in a certain switching chamber in this provision, then the switching chamber is not automatically actuated by the rest spring of another switching chamber. Therefore, such switches do not meet the safety requirements forming the base for the subject matter of the application.

The U.S. Pat. No. 3,142,732 (Texas Instruments) refers to a three-pole excess current release with three switching chambers disposed next to each other, which are connected to each other with a crossbar and which can be switched on again after release with a joint reset button. The object of such thermal switches is to cause a response of the two other switches upon a response by one switch. However, this is a completely different field of application as compared to the subject matter of the present invention and no teaching is provided referring to the assurance of the switch-off safety upon breakage of one of the reset springs of one of the key switches.

The German Patent DE-PS No. 667,361 (AEG) shows only the disposition of several contact bridges disposed next to each other at a joint crossbar in a bistable toggle switch. Again, there is no suggestion here relating to the necessary safety of switching off of a key switch.

The following documents are also known to us as relating to the further state of the art: German Patent DE-PS No. 644,081 (AEG), French Patent FR-PS No. 64,500 (SA d'Appareillage Blinde), German Patent Laid Out DE-AS No. 2,618,572 (R. Schadow), and German Patent Application Laid Open DE-OS No. 2,702,225 (Westinghouse).

Additional safety requirements exist if the key switch is employed as a safety element, for example for providing barriers at punching machines against unauthorized manual access during a machine work operation or as a door contact, where it is to be assured that in case of an opened door no further dangerous contact voltages exist. The latter requirements require more than a reset element at the switch actuating the switch, which would result in additional construction depth in case of conventional constructions.

SUMMARY OF THE INVENTION

1. Purposes of the Invention

It is an object of the invention to decrease the manufacturing expenses and the construction height of a multipole key switch while meeting the safety requirements.

It is another object of the invention to provide a key switch which in case of failure of a spring leaves the circuit in a dangerfree condition.

It is a further object of the present invention to provide a key switch which is of a simple reliable construction.

These and other objects and advantages of the present invention will become evident from the description which follows.

2. Brief Description of the Invention

The present invention provides a multipole key switch with an actuating ram longitudinally slidable against the force of a restoring spring. The actuating ram engages at least two contact bridges disposed next to each other and placed under a spring restoring force for the shorting out or, respectively, lifting off from fixed position contact fingers each disposed in one of three switching chambers placed next to each other. The pretensioning force of the springs of the contact bridges generates the required contact pressure and each switching chamber is provided with its own restoring spring. A cross-web is disposed at the actuating ram adjacent to the inner side of the upper part of the case. This cross-web is provided with individual contact carriers penetrating into the individual switching chambers at which contact carriers in each case a contact bridge is hung rockingly around its bridge center. Restoring springs which provide the restoring force for the actuating ram are supported at the the cross-web. The strength of the restoring springs is laid out such that in case of a failure of one of the restoring springs, the restoring force of the remaining restoring springs is sufficient to open the contact bridges of all switching chambers and to place the actuating ram in its rest position.

In order to ensure that the actuating ram can never become clamped even in the case of a one-sided load, it is provided with an additional side guide at least in the direction into which the cross-web extends.

Contact fingers can be disposed in the switching chambers for being contacted by the contact bridges upon depression of the actuating ram to close an electrical contact. Spring tabs can be attached to the case for mounting the switch. A guide track can be furnished for the actuating ram. A stop can be disposed at the end of each contact finger. An opening can be provided at the center of each contact bridge. One contact compression spring can be provided for each chamber, which is supported on one side at the cross-web and on the other side in each case at one of the contact bridges thereby keeping the actuating ram in a certain position. A pin can be located in each switching chamber and is preferably joined to a bottom part of the case for guiding the respective restoring spring. An additional side guide can be provided for the ram in the direction into which the cross-web extends. Side guide tracks can be disposed at the switching chambers and a switching chamber disposed in the middle. The additional side guide can comprise two parallel ribs, which ribs extend between the middle contact bridge and the neighboring contact bridges and which side ribs slide along at side guide tracks of the middle switching chamber. A bearing support can be provided for the actuating ram. In case of three springs present the force of two of the restoring springs preferably is sufficient to open the contact bridges of all switching chambers and to place the actuating ram to its rest position. Means can be provided for preventing the actuating ram from being clamped.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention.

DESCRIPTION OF INVENTION AND PREFERRED EMBODIMENT

Figure 1:
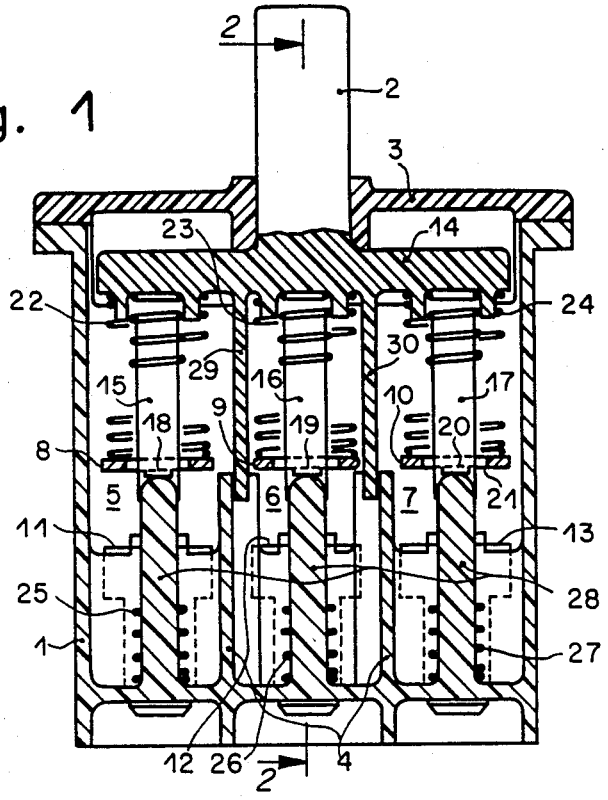
FIG. 1 is a longitudinal sectional view of a multipole key switch along section line 1—1 of FIG. 2.

In accordance with the present invention there is provided a multipole key switch where 1 is the bottom part of the case of a triple pole key switch or pushbutton switch with an actuating ram 2, which is longitudinally slidably disposed both in the upper part 3 of the case as well as in a guide track 4 (FIG. 1) of the case bottom part 1. Three switching chambers 5, 6, 7 are disposed next to each other in the case bottom part 1. Each of the switches is provided with one contact bridge 8, 9, 10 each and two corresponding contact fingers 11, 12 (FIG. 2), 13 in each case. The contact bridges 8, 9, 10 can be actuated from a single actuating ram 2. A cross web 14 is formed for this purpose at the inside wall of the case upper part 3 following the actuating ram 2, which is provided with three different contact supports 15, 16, 17. The contact supports 15, 16, 17 enter and/or penetrate into the individual switching chambers 5 or, respectively, 6 or 7 and comprise two elastic fingers each, of which only two fingers **16*a*, 16*b* of the contact support 16 are visible in the representation of FIG. 2. The ends of the elastic fingers of each contact support 15, 16, 17 are formed to a stop 18, 19, 20 (FIG. 1) in each case, of which the stops 19*a* and 19*b* of the contact support 16 are shown in FIG. 2. One of the contact bridges 8 or, respectively, 9 or 10 is rockingly hanging at each contact support around its bridge center, for which purpose each of the contact bridges 8, 9, 10 is provided with a center opening 21. The elastic fingers of the contact bridges 15, 16, 17 penetrate one of the contact bridges 8, 9, 10 in each case in their opening 21 and with the stops 18, 19, 20 they prevent the contact bridges 8, 9, 10** from falling out.

In the rest position of the actuating ram 2 the contact bridges 8, 9, 10 are pressed against their stops 18, 19, 20 with in each case a contact compression spring 22, 23, 24, which is supported on the one side at the cross-web 14 and on the other side at in each case one of the contact bridges 8, 9, 10 and thus the actuating rams are kept in a certain position.

Figure 2:
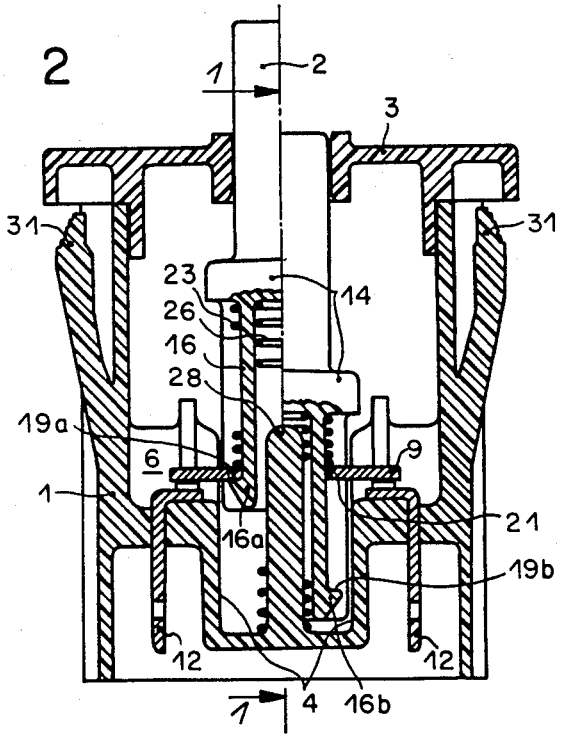
FIG. 2 is a side sectional view along section line 2—2 of FIG. 1, where the left and right half of the FIG. 2 are represented as two different switching positions.

The actuating ram 2 is shown in its rest position in FIG. 1, that is, at an open key switch.

The actuating ram 2 is pressed in far enough on the left side of FIG. 2 that the contact bridges 8, 9, 10 just touch the contact fingers 11, 12, 13. Thus the key switch is electrically closed. An additional run distance is available for balancing tolerances in the length of the path of an operating member. The position of the actuating ram 2 is shown on the right hand side of FIG. 2 at the end of the possible additional run distance. The generated contact pressure is provided by the contact compression springs 22, 23, 24.

Each switching chamber 5, 6, 7 is provided with its own restoring spring 25, 26, 27 for resetting the actuating ram 2. The restoring springs 25, 26, 27 are supported on the one hand at the cross-web 14 and on the other hand at the bottom of the switching chambers 5, 6, 7, that is at the lower part of the case 1. Three pins 28 each protruding into one of the switching chambers 5, 6, 7 are joined to the bottom part of the case 1 and serve to guide the restoring springs 25, 26, 27. The restoring springs 25, 26, 27 are stuck onto these pins 28. The strength of the restoring springs 25, 26, 27 is provided such that upon failure of one of the restoring springs 25, 26, 27 the spring strength of the remaining springs 25, 26, 27 is sufficient to open the contact bridges 8, 9, 10 of all switching chambers 5, 6, 7 and to place the actuating ram 2 into its rest position. The actuating ram 2 can never be allowed to become clamped. In order to assure this even in case of a one-sided load, the actuating ram 2 is provided with an additional side guide at least in the direction into which the cross-web 14 extends. The guide comprises two parallel ribs 29, 30 (FIG. 1) in the example described, which ribs extend between the middle contact bridge 9 and the two outer contact bridges 8 and 10 and slide along at the side guide tracks 4 of the middle switching chamber 6.

The actuating ram 2 cannot get clamped even if one of the outer restoring springs 25, 27 fails due to a breakage of the spring and the two remaining springs operate by themselves, because of the double guidance of the actuating ram 2 on the one hand in the upper case part 3 and on the other hand in the guide tracks 4. The remaining restoring springs nevertheless will be able to move the actuating ram 2 into its rest position.

Spring tabs 31 (FIG. 2) formed to the lower part of the case 1 are provided for the incorporation of the key switch, which retain the key switch with spring force in a conventional manner in a corresponding recess of a sheet metal plate.

The construction described allows the economical production of key switches assured to switch off, which meet the required safety regulations and which also are provided with the necessary air gaps and creep distances for use at low voltage grids despite small space requirements. Also their mounting is very simple and does not require special tools.

It will be understood that each of the elements described above, or two or more together, may also find a useful application in other types of multipole key switches differing from the types described above.

While the invention has been illustrated and described as embodied in the context of a multipole key switch it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A multipole key switch comprising a case;

a plurality of individual switching chambers disposed in the case;

an actuating ram longitudinally slidable within the case from a rest position;

a cross-web disposed at the actuating ram adjacent to the inner side of the upper part of the case;

individual contact supports provided at the cross-web, which individual contact supports penetrate into the individual switching chambers;

a contact bridge disposed on each contact support and hung rockingly around its bridge center for making contact with fixed position contact fingers disposed within said chambers, when said actuating ram is longitudinally slid within said case from said rest position;

a restoring spring for each switching chamber, for contributing to a restoring force for the actuating ram to restore the rest position of the actuating ram against said longitudinal slidability, the strength of the restoring springs being chosen such that in case of a failure of one of the restoring springs the restoring force of the remaining restoring springs is sufficient to restore the actuating ram to its rest position.

2. Multipole key switch according to claim 1 further comprising one contact compression spring for each chamber, which is supported on one side at the cross-web and on the other side in each case at one of the contact bridges.

3. Multipole key switch according to claim 1 further comprising guide tracks disposed at one of the switching chambers;

said one switching chamber being a middle switching chamber;

wherein said key switch further comprises two parallel ribs, which ribs extend from said cross web and which ribs slide along said guide tracks of said middle switching chamber.

4. Multipole key switch according to claim 1 wherein in case of three springs present the force of two of the restoring springs is sufficient to open the contact bridges of all switching chambers and to place the actuating ram to its rest position.

5. Multipole key switch according to claim 1 further comprising means for preventing the actuating ram from being clamped.

* * * * *